US011509060B2

(12) United States Patent
Leung et al.

(10) Patent No.: US 11,509,060 B2
(45) Date of Patent: Nov. 22, 2022

(54) FILTER-ANTENNA AND METHOD FOR MAKING THE SAME

(71) Applicant: City University of Hong Kong, Kowloon (HK)

(72) Inventors: Kwok Wa Leung, Kowloon Tong (HK); Yan Ting Liu, Kowloon (HK); Nan Yang, Kowloon (HK)

(73) Assignee: City University of Hong Kong, Kowloon (HK)

( * ) Notice: Subject to any disclaimer, the term of this patent is extended or adjusted under 35 U.S.C. 154(b) by 564 days.

(21) Appl. No.: 16/658,388

(22) Filed: Oct. 21, 2019

(65) Prior Publication Data

US 2021/0119342 A1 Apr. 22, 2021

(51) Int. Cl.

| | |
|---|---|
| ***H01Q 17/00*** | (2006.01) |
| ***H01Q 9/04*** | (2006.01) |
| ***H01Q 1/48*** | (2006.01) |
| ***H01Q 9/30*** | (2006.01) |
| ***H01Q 19/00*** | (2006.01) |

(52) U.S. Cl.

CPC ..... *H01Q 17/00* (2013.01); *H01Q 1/48* (2013.01); *H01Q 9/045* (2013.01); *H01Q 9/30* (2013.01); *H01Q 19/005* (2013.01)

(58) Field of Classification Search

CPC ..... H01Q 17/00; H01Q 1/48; H01Q 9/045; H01Q 9/30; H01Q 19/005

See application file for complete search history.

(56) References Cited

U.S. PATENT DOCUMENTS

| | | | | |
|---|---|---|---|---|
| 4,475,092 | A | 10/1984 | Epsom et al. | |
| 6,147,572 | A | 11/2000 | Kaminski et al. | |
| 6,856,290 | B1 | 2/2005 | Ryken | |
| 7,180,473 | B2 | 2/2007 | Horie et al. | |
| 7,193,567 | B1 * | 3/2007 | Ryken, Jr. | H01Q 9/0414 343/846 |
| 8,237,518 | B2 | 8/2012 | Andreasson | |
| 8,655,290 | B2 | 2/2014 | Yagi et al. | |
| 9,054,668 | B2 | 6/2015 | Gorostegui | |
| 9,078,371 | B2 | 7/2015 | Brown et al. | |
| 10,141,638 | B2 * | 11/2018 | Rao | H01Q 15/006 |
| 10,271,295 | B2 * | 4/2019 | Tsai | H04B 7/0695 |
| 10,439,277 | B2 * | 10/2019 | Rao | H01Q 1/286 |
| 2005/0090300 | A1 * | 4/2005 | Zhang | H04B 1/3833 455/575.1 |
| 2012/0092219 | A1 * | 4/2012 | Kim | H01Q 1/40 343/700 MS |

(Continued)

FOREIGN PATENT DOCUMENTS

| | | | | |
|---|---|---|---|---|
| CA | 2585492 C | * | 6/2014 | H01Q 1/22 |
| CN | 204011721 | | 12/2014 | |

(Continued)

OTHER PUBLICATIONS

PCT/CN2020/121825—Written Opinion.
PCT/CN2020/121825—Search Report.

*Primary Examiner* — Hoang V Nguyen
(74) *Attorney, Agent, or Firm* — Renner Kenner Greive Bobak Taylor & Weber

(57) ABSTRACT

A filter-antenna and a method for making a filter-antenna. The filter antenna includes a microstrip antenna, such as a patch antenna, integrated with an absorptive (e.g., bandstop) filter for absorbing or dissipating energy.

26 Claims, 10 Drawing Sheets

(56) References Cited

U.S. PATENT DOCUMENTS

2014/0022139 A1 1/2014 Rao et al.

FOREIGN PATENT DOCUMENTS

| | | |
|---|---|---|
| CN | 102723601 | 1/2015 |
| CN | 104518278 | 4/2015 |
| CN | 204732538 | 10/2015 |
| CN | 106252872 | 12/2016 |
| CN | 104871367 | 1/2018 |
| CN | 103682625 | 3/2018 |
| KR | 20150040592 | 1/2016 |

* cited by examiner

FILTER-ANTENNA AND METHOD FOR MAKING THE SAME

TECHNICAL FIELD

The invention relates to a filter-antenna and a method for making the filter-antenna. The invention also relates to a communication device that includes the filter-antenna.

BACKGROUND

Filters and antennas are common and important components in communication devices. A filter-antenna (or filtering-antenna) is a device that combines an antenna and a filter.

Existing filter-antennas are reflective filter-antennas. These reflective filter-antennas reflect most of the incident energy in the stopband. The reflected energy may be transferred to other components (e.g., a power amplifier associated with the filter-antenna) in the system, which may lead to instability (e.g., self-oscillation in the power amplifier). One option to avoid or mitigate this instability problem is to use isolators, circulators, and/or attenuators in the system to reduce the effect of the reflected energy on the system. However, this option would increase the number of the components in the system, making the system cumbersome and expensive while potentially increasing the insertion loss.

SUMMARY OF THE INVENTION

In accordance with a first aspect of the invention, there is provided a filter-antenna, comprising a microstrip antenna integrated with an absorptive filter for absorbing or dissipating energy. By absorbing or dissipating the energy, e.g., energy received from an external source, reflection of energy (which may otherwise affect stability of other components/devices) can be prevented, reduced, or eliminated. The filter-antenna can be used for transmission, receiving, or both.

In one embodiment of the first aspect, the microstrip antenna is a patch antenna. The patch antenna has a relatively low profile.

In one embodiment of the first aspect, the absorptive filter is a band-stop filter for absorbing or dissipating stopband energy.

In one embodiment of the first aspect, the microstrip antenna includes a substrate, a ground plane arranged a first face of the substrate, and a microstrip network arranged on a second, opposite face of the substrate. The microstrip antenna may include further layers or components. The absorptive filter includes a filter element at least partly arranged inside the substrate. Preferably, the filter element is arranged substantially completely inside the substrate.

In one embodiment of the first aspect, the filter element comprises a resistor. The resistor may be a chip resistor.

In one embodiment of the first aspect, the absorptive filter further comprises: a defected microstrip structure arranged in the microstrip network and a defected ground structure arranged in the ground plane. The defected microstrip structure and the defected ground structure are operably connected with the filter element.

In one embodiment of the first aspect, the microstrip antenna is a patch antenna and the microstrip network comprises a patch. The patch may be arranged centrally of the substrate.

In one embodiment of the first aspect, the patch includes a central portion, and the defected microstrip structure comprises one or more slots arranged (e.g., etched) in the central portion of the patch. The slot(s) may be U-shaped. The central portion of the patch may include one or more open stubs each associated with a respective slot. In one example, the patch has two open stubs, e.g., two $\lambda_g/4$ open stubs, where $\lambda_g$ is the guided wavelength at the center frequency.

In one embodiment of the first aspect, the patch further includes a first side portion connected with and arranged a first side of the central portion and a second side portion connected with and arranged at a second, opposite side of the central portion. Each of the first and second side portions includes one or more stubs. In one example, each of the first and second side portions includes a dual-stub or a dual-stub feed. The stubs in the dual stub or dual stub feed can be of different lengths.

In one embodiment of the first aspect, the patch is symmetric about an axis of symmetry. The central portion of the patch may also be symmetric about the axis of symmetry.

In one embodiment of the first aspect, the defected ground structure comprises one or more slots (e.g., etched) arranged in the ground plane. The defected ground structure may comprise a central slot corresponding to the central portion of the patch. The central slot may be U-shaped. In plan view, the central slot may overlap with the central portion of the patch.

The defected ground structure may further comprise a first side slot arranged on a first side of the central slot and a second side slot arranged on a second, opposite side of the central slot. The first and second side slots are arranged to assist in absorbing or dissipating the energy. The first and second side slots can be symmetrically disposed about the axis of symmetry. The first and second side slots may have the same shape and size. The first and second side slots may be a generally-q shaped.

In one embodiment of the first aspect, the microstrip network further comprises one or more parasitic patches operably connected with the patch. The one or more parasitic patches may be spaced apart from the patch. The one or more parasitic patches may comprise two parasitic patches arranged at opposite sides of the patch. The two parasitic patches may be slotted patches each having one or more slots. In one example, the slot is rectangular. The two parasitic patches may be equally spaced apart from the patch and symmetrically disposed about the patch.

In one embodiment of the first aspect, the patch antenna has a coaxial feed that extends through the substrate and connects with the patch. In one example, the coaxial feed is connected at one end of the patch and the filter element is connected at another end of the patch. The coaxial feed may extend perpendicular to the face of the substrate.

In a second aspect of the invention, there is provided a communication device comprising the filter-antenna of the first aspect. The communication device may be a wireless communication device. The communication device may be part of a communication system.

In a third aspect of the invention, there is provided a method for making a filter-antenna, comprising forming a microstrip antenna integrated with an absorptive filter for absorbing or dissipating energy. The forming includes forming a microstrip antenna; and integrating, in the microstrip antenna, an absorptive filter for absorbing or dissipating energy. The two steps can be performed simultaneously.

In one embodiment of the third aspect, forming the microstrip antenna comprises forming a patch antenna.

In one embodiment of the third aspect, forming the microstrip antenna comprises forming a microstrip network on a first face of a substrate of the microstrip antenna.

In one embodiment of the third aspect, forming the microstrip antenna further comprises forming a defected microstrip structure in the microstrip network.

In one embodiment of the third aspect, forming the microstrip antenna further comprises forming a defected ground structure on a ground plane on a second, opposite face of the microstrip antenna.

In one embodiment of the third aspect, integrating the absorptive filter comprises forming a hole in the substrate for receiving a filter element of the absorptive filter. Integrating the absorptive filter may further include arranging the filter element of the absorptive filter in the hole.

In one embodiment of the third aspect, arranging the filter element of the absorptive filter in the hole comprises arranging the filter element of the absorptive filter arranged substantially completely in the hole.

In one embodiment of the third aspect, the method further comprises forming an electric connection between the filter element and the ground plane and an electric connection between the filter element and the microstrip network. Forming the electric connection may include welding or soldering.

In one embodiment of the third aspect, the filter element comprises a resistor. The resistor may be a chip resistor.

BRIEF DESCRIPTION OF THE DRAWINGS

Embodiments of the invention will now be described, by way of example, with reference to the accompanying drawings in which.

DETAILED DESCRIPTION

Figure 1:
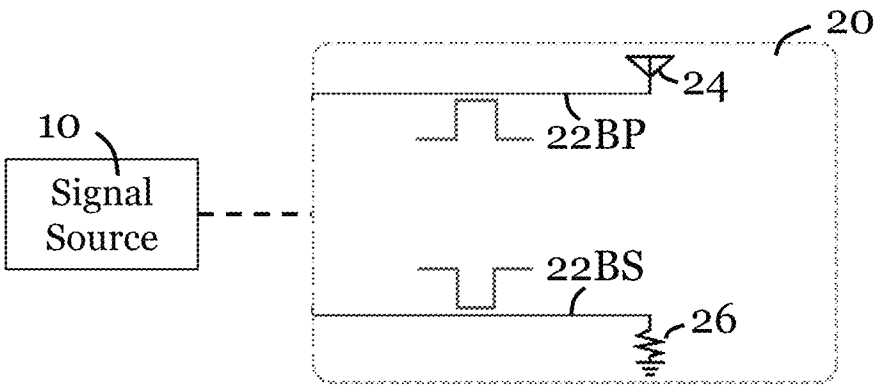
FIG. 1 is a schematic diagram showing a filter-antenna in one embodiment of the invention.

FIG. 1 is a schematic of a filter-antenna 20 in one embodiment of the invention. The filter-antenna 20 is operably connected with a signal (e.g., energy) source 10 such as a power amplifier to receive a signal (e.g., energy) from the signal source 10. The filter-antenna 20 includes a bandpass channel 22BP and a band-stop channel 22BS. The bandpass channel 22BP is connected with an antenna element 24. The band-stop channel 22BS is connected with a filter element 26 illustrated as a resistor. The energy in the passband received at the bandpass channel 22BP is transmitted to the antenna element 24; the energy in the stopband received at the band-stop channel 22BS is absorbed or dissipated by the resistor 26. Thus, the energy reflection in both the passband and the stopband is reduced, minimized, and preferably substantially eliminated, to avoid possible detrimental effects on neighboring components (e.g., the power amplifier).

FIGS. 2A to 2D illustrate a filter-antenna 200 in one embodiment of the invention. The filter-antenna 200 generally includes a microstrip antenna integrated with an absorptive filter for absorbing or dissipating energy. In this embodiment, the microstrip antenna is a patch antenna and the absorptive filter is a band-stop filter for absorbing or dissipating stopband energy.

As shown in FIGS. 2A to 2D, the filter-antenna 200 includes a substrate 202, a patch network 204 formed by conductive patches on an upper face of the substrate 202, and a ground plane 206 formed by a conductive surface on a lower face of the substrate 202. The substrate 202 has a dielectric constant $\varepsilon_{rs}$. The substrate 202 has a thickness (in z-direction) t, and an area (in x-y plane) of G×G. A coaxial connector or feed connector 208, with an inner cable of radius $r_1$, is attached to the lower surface of the substrate 202 and penetrates through the substrate 202 to connect with a patch 204A of the patch network 204. The cable feed 208 is soldered to the patch 204A for exciting the filter-antenna 200.

Figure 2B:
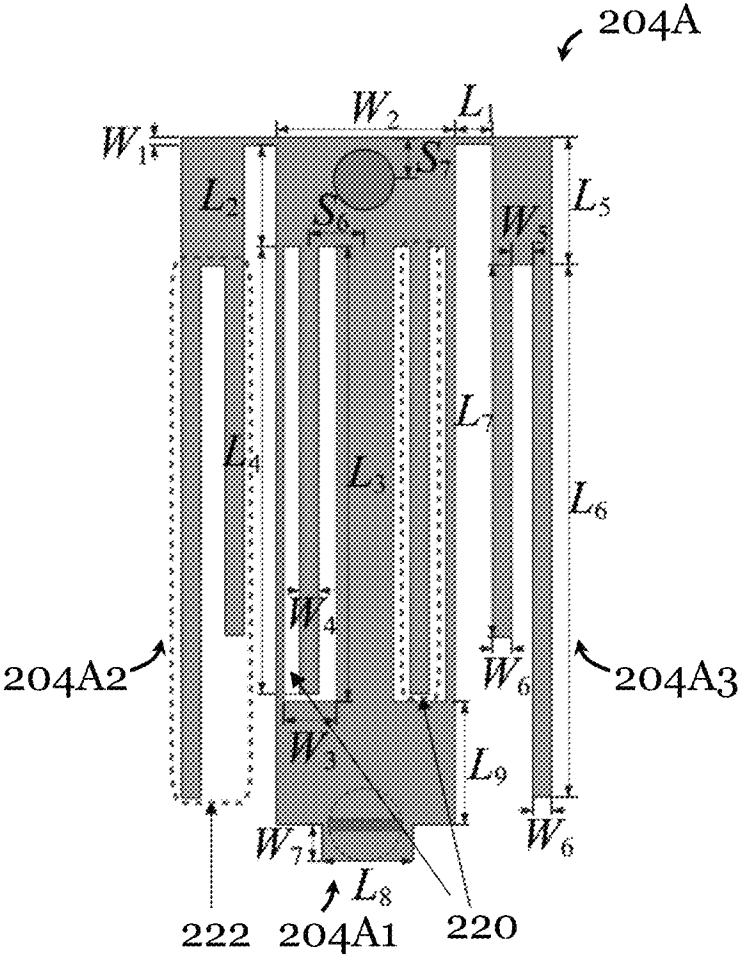
FIG. 2B is an enlarged view of a patch in the filter-antenna of FIG. 2A.
Figure 2A:
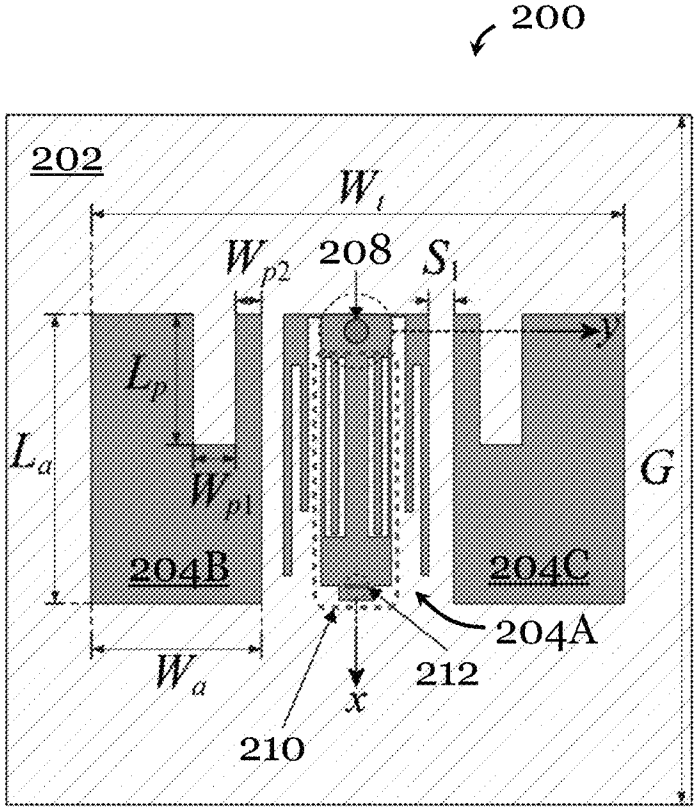
FIG. 2A is a top view of a filter-antenna in one embodiment of the invention.

As best shown in FIGS. 2A and 2B, the patch network 204 includes a main patch 204A and two side patches 204B, 204C arranged on respective sides of the main patch 204A. The main patch 204A includes a central portion 204A1 and two side portions 204A2, 204A3 arranged on two sides of the central portion 204A1. The central portion 204A1 includes two generally U-shaped slots 220 disposed symmetrically about an axis of symmetry (in x-direction) of the main patch 204A. Each of the U-shaped slots 220 is associated with a respective open stub (surrounded by a dotted loop near 220), a $\lambda_g/4$ open stub ($\lambda_g$ is the guided wavelength). Each of the side portions 204A2, 204A3 include a dual-stub or a dual-stub feed 222. Each dual stub feed 222 include stubs of lengths of $L_6$ and $L_7$ ($L_6>L_7$) separated by width $W_5$. The two stubs have the same width of $W_6$. The central portion 204A1 is connected with the feed 208 at one end and with a resistor element 214 in the other end.

The two side patches 204B, 204C are parasitic slotted patches. Each of the patches 204B, 204C is generally rectangular and includes a rectangular slot. The two side patches 204B, 204C are symmetrically disposed about the axis of symmetry (in x-direction) of the main patch 204A. The two side patches 204B, 204C are also aligned with the main patch 204A in that their top edges (in the x-direction) are on the same level and their bottom edges (in the x-direction) are on the same level. Each of the slotted patches 204B, 204C has a length of $L_a$ and width of $W_a$, and is respectively spaced apart from the edge of the main patch 204A by a distance $S_1$. The rectangular slot has a length of $L_p$ and width of $W_{p1}$.

Figure 2D:
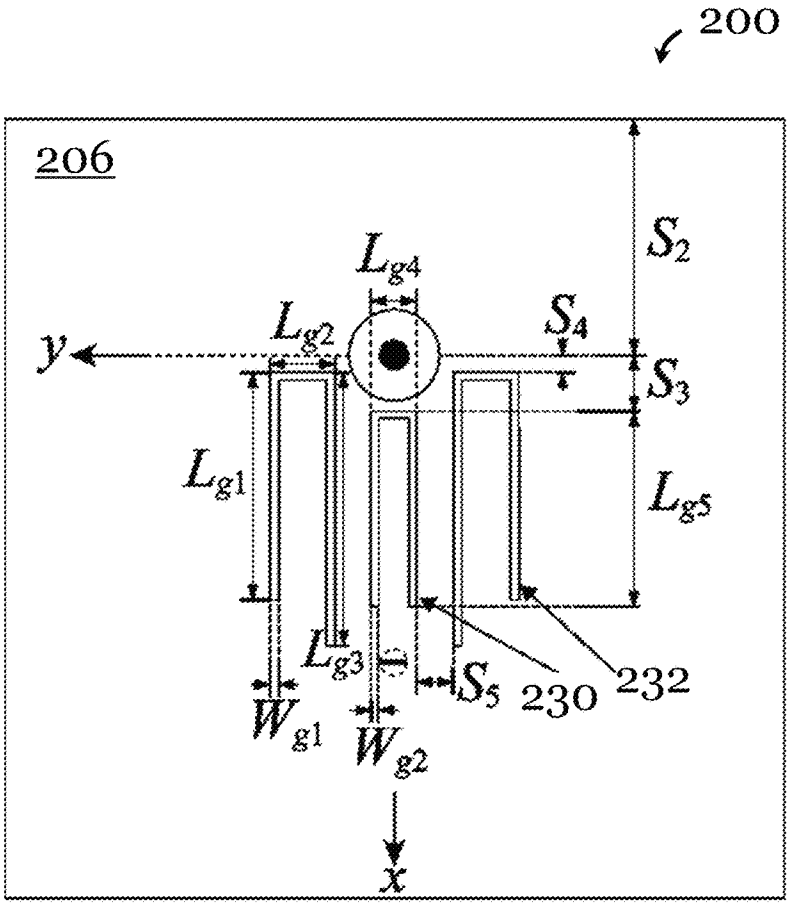
FIG. 2D is a bottom view of the filter-antenna of FIG. 2A.

FIG. 2D shows the ground plane 206. The ground plane 206 is generally a flat conductive surface with three slots. At the center of the ground plane 206, which, in plan view, correspond to the main patch 204A is a U-shaped slot, a $\lambda_g/2$ U-shaped slot 230 formed (e.g., etched) in the ground plane 206. Two generally-η shaped side slots 232 are arranged on two sides of the U-shaped slot 230 to improve the suppression level of the lower stopband.

Figure 2C:
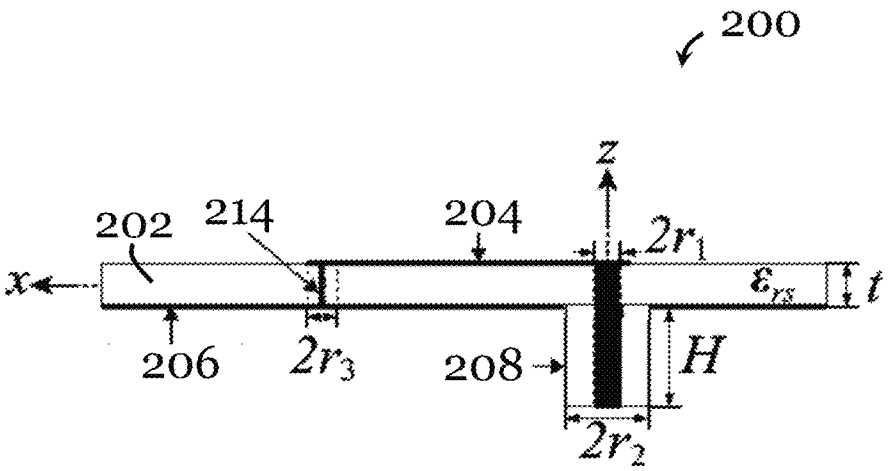
FIG. 2C is a side view of the filter-antenna of FIG. 2A.

FIG. 2C shows the filter element 214 at least partly arranged inside the substrate 202. In this embodiment, the filter element 214 is a chip resistor embedded in the substrate 202 (a small hole formed in the substrate 202) for absorbing or dissipating stopband energy. The chip resistor has a resistance of 47*n*. One end of the chip filter is soldered to the main patch 204A whereas the other end of the chip filter is soldered to the ground plane 206.

The filter-antenna 200 of FIGS. 2A to 2D includes a filter integrated into the patch antenna. The filter is formed by a defected microstrip structure arranged in the microstrip network 204, the chip resistor 214, and a defected ground structure arranged in the ground plane 206. The defected microstrip structure includes the stubs and slots 220 arranged in the central portion 204A1. The defected ground structure includes the slots 230, 232 formed in the ground plane 206. The filter can be considered as a resistor-terminated band-stop filter (BSF) 210.

Figure 3:
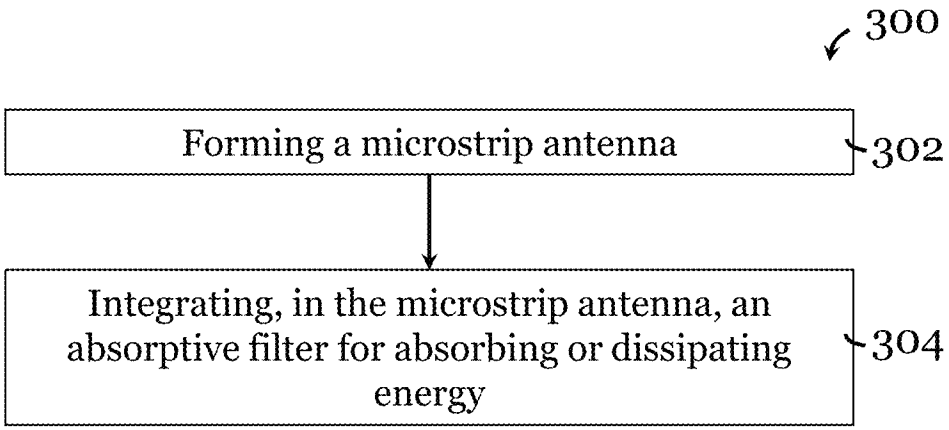
FIG. 3 is a flow chart illustrating a method for making a filter-antenna in one embodiment of the invention.

FIG. 3 shows a method 300 for making a filter-antenna in one embodiment of the invention. The filter-antenna could be the one in FIGS. 2A to 2D. The method 300 includes, in step 302, forming a microstrip antenna, and in step 304, integrating, in the microstrip antenna, an absorptive filter for absorbing or dissipating energy. The two steps 302, 304 may be carried out in the order stated, or simultaneously. The microstrip antenna may be a patch antenna. In one example, forming the microstrip antenna includes processing a PCB substrate (substrate+metallic layers on opposite faces of the substrate). Specifically forming the microstrip antenna may include forming a microstrip network on a first face of a substrate of the microstrip antenna, forming a defected microstrip structure in the microstrip network, and/or forming a defected ground structure on a ground plane on a second, opposite face of the microstrip antenna. The absorptive filter may be integrated in the substrate by forming (e.g., drilling) a hole in the substrate, then arranging the filter element in the hole. The filter element of the absorptive filter can be arranged substantially completely in the hole. Electric connections between the filter element and the ground plane may be formed by soldering or welding. Likewise, Electric connections between the filter element and the microstrip network may be formed by soldering or welding.

Figure 4B:
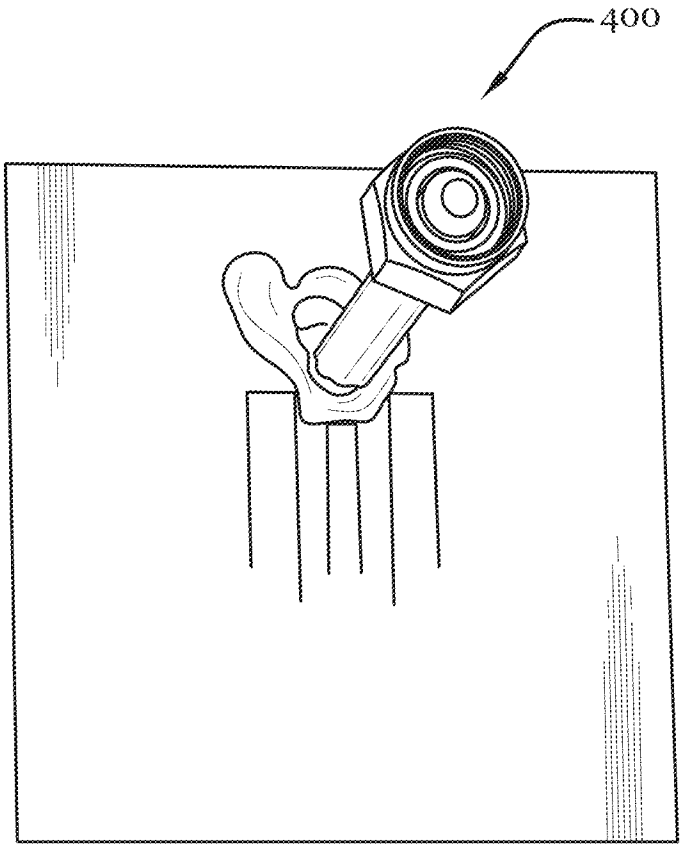
FIG. 4B is a picture showing a bottom surface of the filter-antenna of FIG. 3A.
Figure 4A:
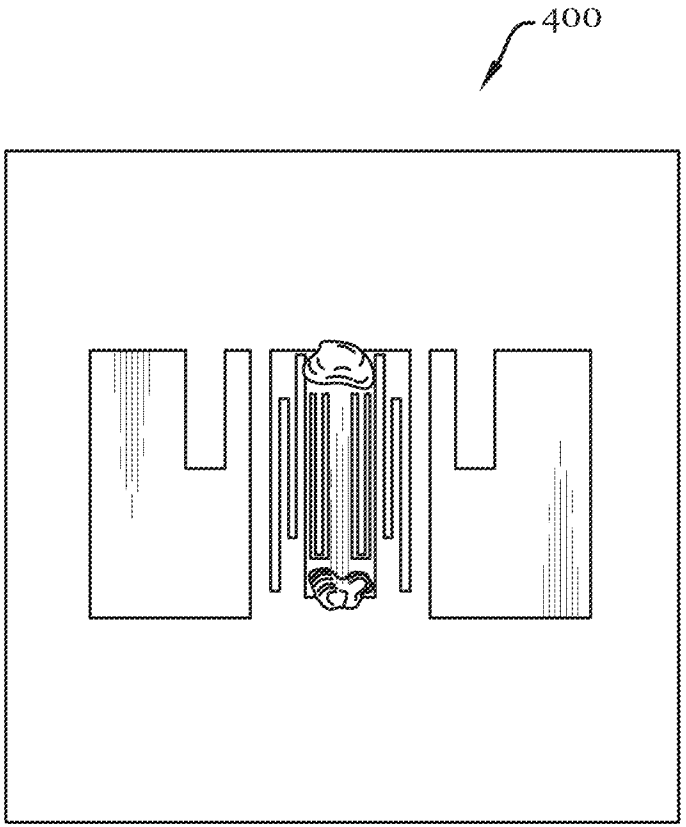
FIG. 4A is a picture showing a top surface of a filter-antenna in one embodiment of the invention.

FIGS. 4A and 4B show the prototype 400 of a filter-antenna fabricated based on the filter-antenna 200 of FIGS. 2A to 2D. Dimensions of the prototype 400 are listed in the following table.

TABLE I

DIMENSIONS OF THE FILTER-ANTENNA PROTOTYPE

| $L_a$ | $W_a$ | $L_p$ | $W_{p1}$ | $W_{p2}$ | $S_1$ | $S_2$ |
|---|---|---|---|---|---|---|
| 15.9 mm | 9.4 mm | 7.2 mm | 2.4 mm | 1.4 mm | 1.3 mm | 12.95 mm |
| $S_3$ | $S_4$ | $S_5$ | $S_6$ | $S_7$ | $r_1$ | $r_2$ |
| 2.55 mm | 0.75 mm | 1.65 mm | 1.2 mm | 0.9 mm | 0.48 mm | 1.8 mm |
| $r_3$ | $L_1$ | $L_2$ | $L_3$ | $L_4$ | $L_5$ | $L_6$ |
| 0.75 mm | 0.7 mm | 2.15 mm | 9.95 mm | 9.8 mm | 2.7 mm | 11.6 mm |
| $L_7$ | $L_8$ | $L_9$ | $W_1$ | $W_2$ | $W_3$ | $W_4$ |
| 8.1 mm | 2 mm | 2.65 mm | 0.15 mm | 4 mm | 1.1 mm | 0.4 mm |
| $W_5$ | $W_6$ | $W_7$ | $L_{g1}$ | $L_{g2}$ | $L_{g3}$ | $L_{g4}$ |
| 0.5 mm | 0.4 mm | 0.8 mm | 10.4 mm | 3 mm | 12.5 mm | 2.1 mm |
| $L_{g5}$ | $W_{g1}$ | $W_{g2}$ | H | G | t | $\varepsilon_{rs}$ |
| 8.9 mm | 0.2 mm | 0.15 mm | 30 mm | 40 mm | 1.575 mm | 2.33 |

Experiments and simulations had been performed to verify the performance of the filter-antenna 400. The experiments performed includes measuring reflection coefficient using an Agilent™ 8753ES vector network analyzer, and measuring radiation pattern, antenna gain, and antenna efficiency using a Satimo™ StarLab System.

Figure 5:
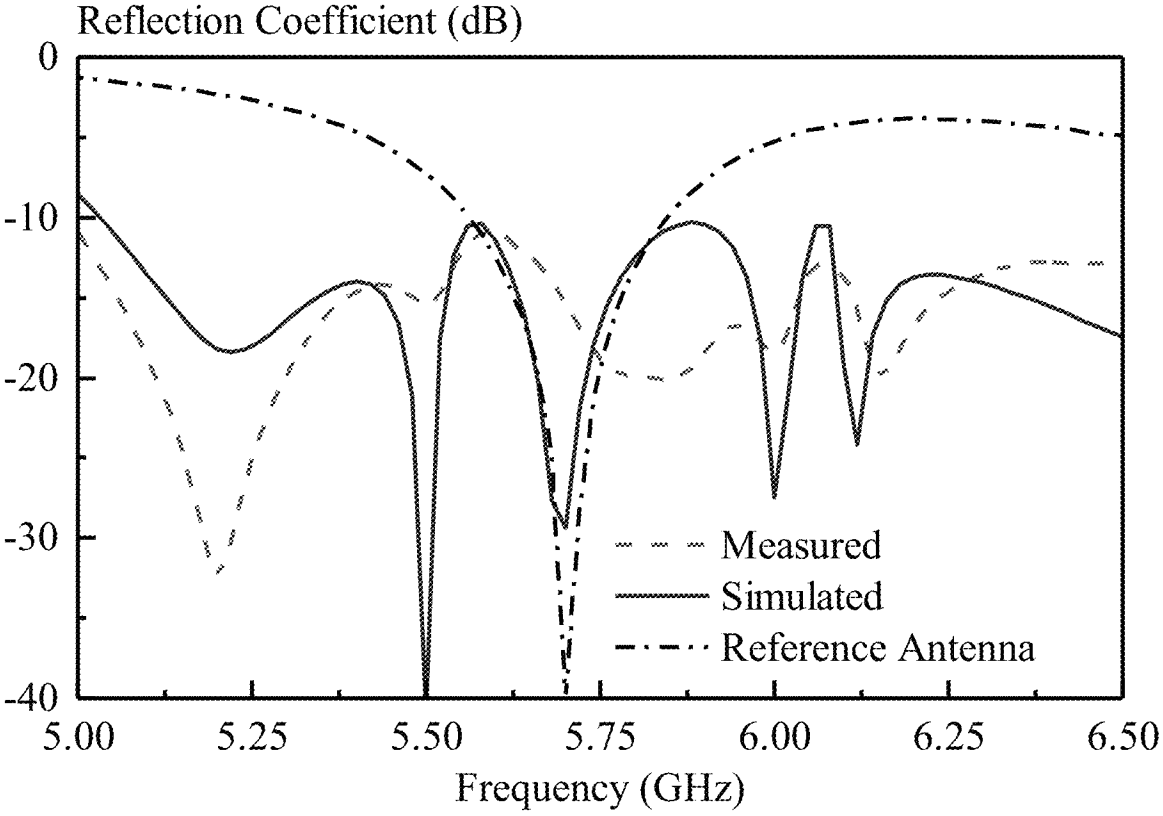
FIG. 5 is a graph showing measured and simulated reflection coefficients of the filter-antenna of FIG. 4A and reflection coefficient of a reference antenna.

FIG. 5 shows the measured and simulated reflection coefficients of the filter-antenna 400 and reflection coefficient of a reference antenna. As shown in FIG. 5, the measured result generally agrees with the simulated result. The measured reflection coefficient is below −10 dB over the entire frequency range (5-6.5 GHz). This demonstrates the reflection-less characteristic of the filter-antenna 400. It is noted that the reflection coefficient of the filter-antenna 400 does not have a sharp selectivity. For comparison, a conventional rectangular patch antenna having the same length of $L_a$ and width of $W_t$ is included here as the reference antenna. Its simulated reflection coefficient is also shown in FIG. 5. It can be seen from FIG. 5 that the impedance bandwidth of the reference antenna is much narrower than that of the filter-antenna 400 although the reference antenna and filter-antenna 400 have the same patch size.

Figures 6A, 6B:
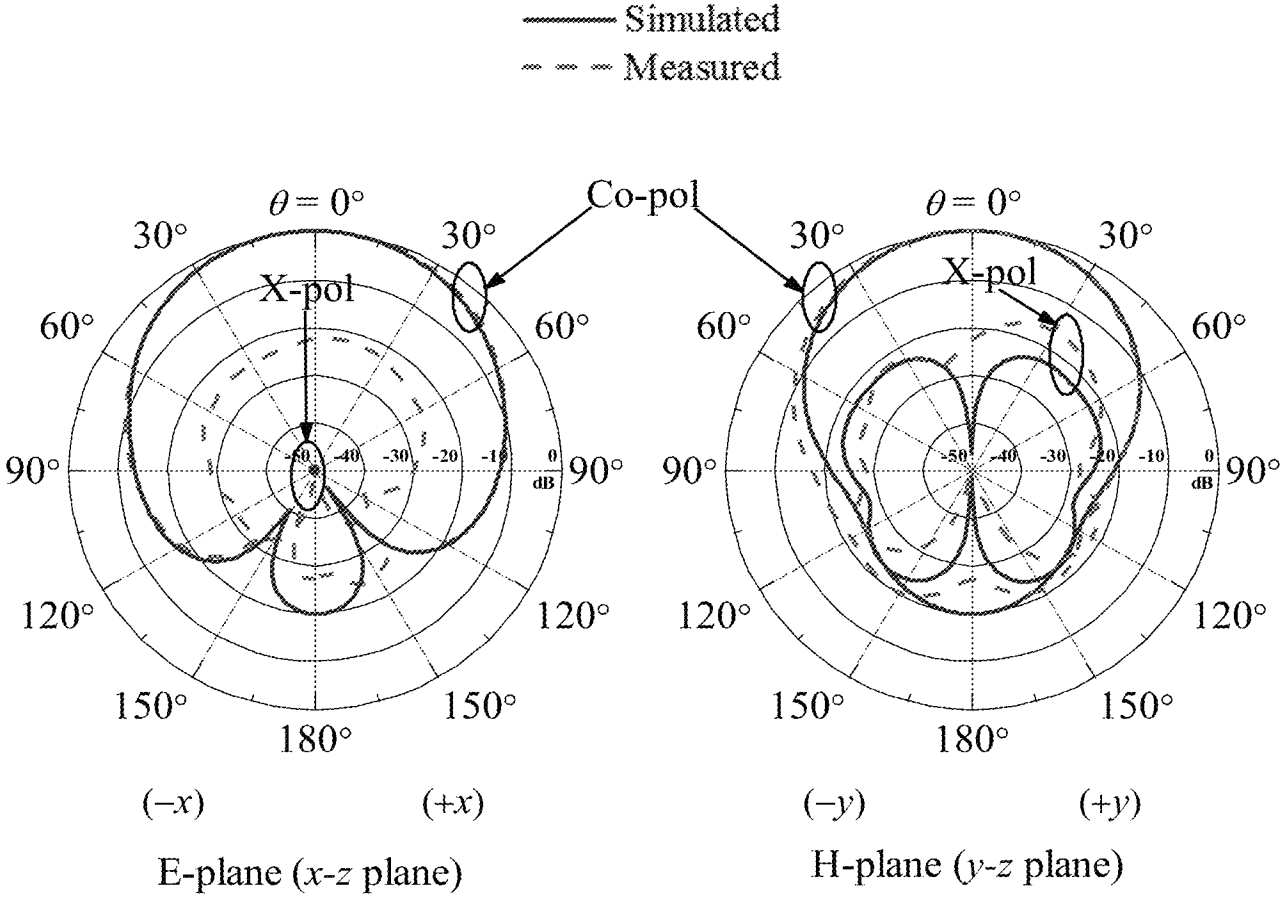
FIG. 6A is a graph showing measured and simulated radiation patterns of the filter-antenna of FIG. 4A in the E-plane (x-z plane) at 5.8 GHz.
FIG. 6B is a graph showing measured and simulated radiation patterns of the filter-antenna of FIG. 4A in the H-plane (y-z plane) at 5.8 GHz.

FIGS. 6A and 6B show the measured and simulated normalized radiation patterns at 5.8 GHz. As shown in FIGS. 6A and 6B, the maximum co-polar field is found in the boresight direction (θ=0°). It is stronger than its cross-polar counterpart by more than 22 dB. The measured H-plane radiation pattern (yz-plane, ϕ=90°) is not symmetric although the filter-antenna 400 is symmetric about the xz-plane. This may be caused by experimental imperfections including assembly errors. It was found that the radiation patterns are stable over the targeted ISM band (5725-5.875 GHz) (results not illustrated).

Figure 7:
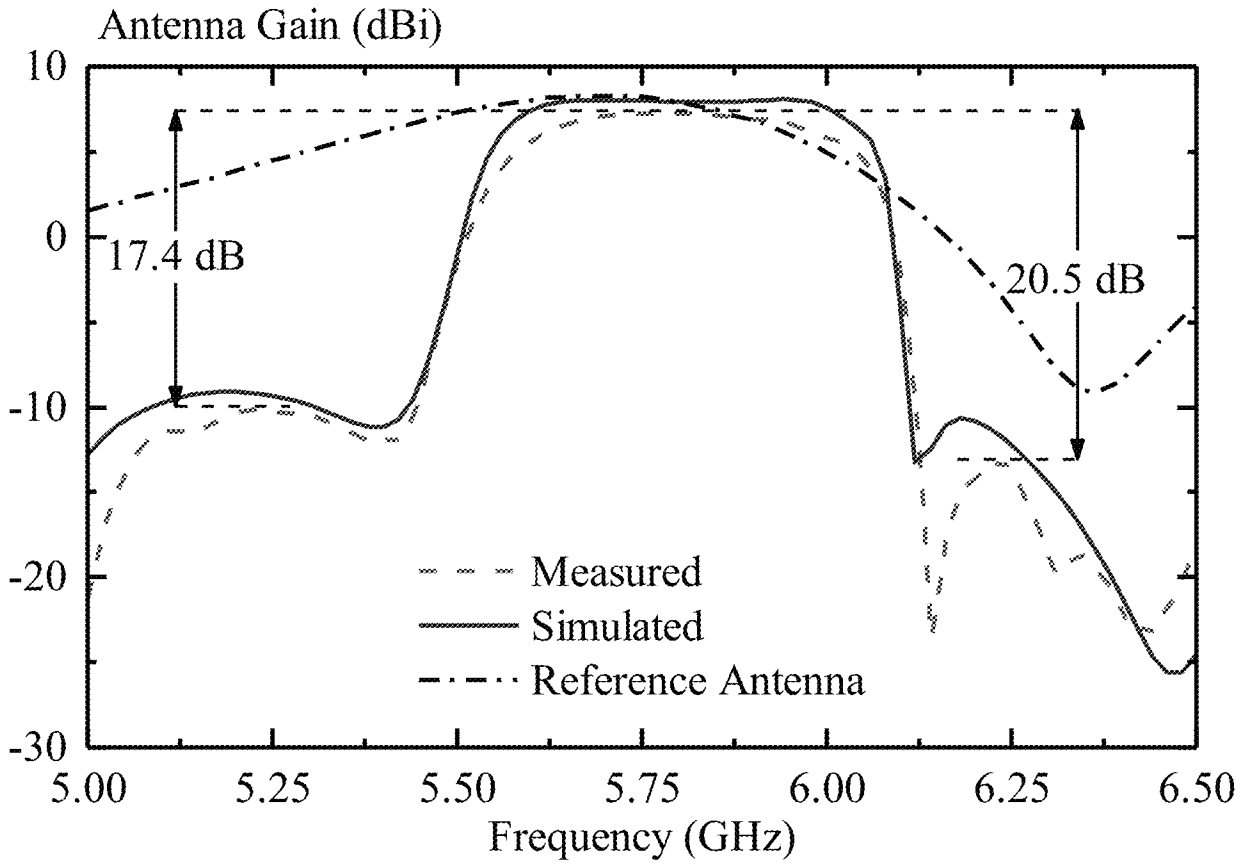
FIG. 7 is a graph showing measured and simulated gain of the filter-antenna of FIG. 3A and gain of a reference antenna.

FIG. 7 shows the measured and simulated realized antenna gains in the boresight direction (θ=0°). With reference to FIG. 7, the measured and simulated results are in good agreement. The measured maximum realized gain is 7.28 dBi at 5.8 GHz, which is 0.78 dB lower than the simulated peak gain (8.06 dBi) at 5.94 GHz due to experimental tolerances. The measured realized antenna gain is higher than 7 dBi from 5.725 to 5.875 GHz, with a measured 1-dB gain bandwidth (gain≥6.28 dBi) of 5.86% (5.63-5.97 GHz). In the upper stopband, two measured radiation nulls with low antenna gains of around −23.5 dBi, along with a sharp roll-off rate for the upper band-edge, are observed. The measured out-of-band suppression level is more than 20.5 dB in the upper stopband (6.12-6.50 GHz). In the lower stopband (5.00-5.44 GHz), another two radiation nulls are measured at 5.41 GHz and below 5.0 GHz, respectively, leading to a suppression level of more than 17.4 dB. The antenna gain of the reference antenna is also shown in the same figure to highlight the filtering characteristic of the filter-antenna 400 of the above embodiment.

Figure 8:
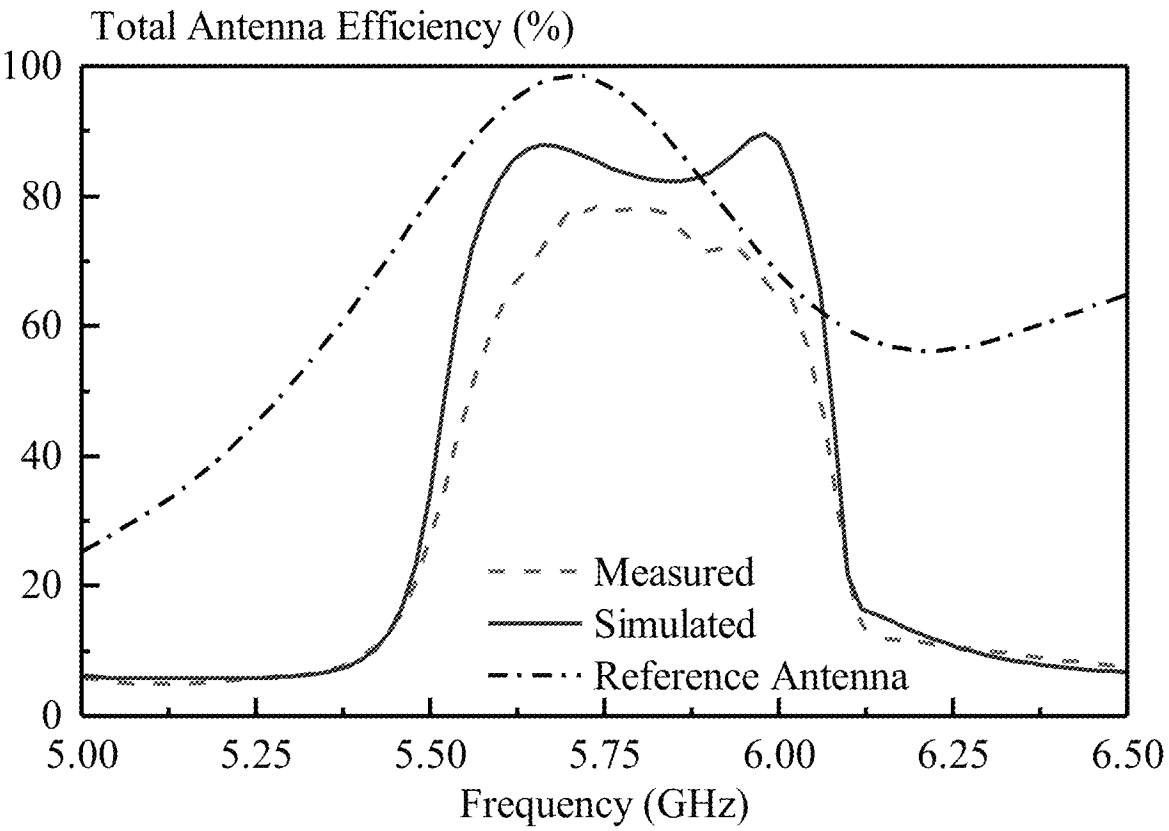
FIG. 8 is a graph showing measured and simulated total antenna efficiency of the filter-antenna of FIG. 4A and total antenna efficiency of a reference antenna.

FIG. 8 shows the measured and simulated total antenna efficiency (mismatch included) of the filter-antenna 400. With reference to FIG. 8, the measured efficiency is higher than 72.5% from 5.725 to 5.875 GHz, with a maximum of 78.5% at 5.74 GHz. The simulated peak efficiency is 89.7% at 5.98 GHz. The efficiency decreases rapidly on the band-edge and then becomes small in the stopbands, giving a sharp selectivity. Since the antenna 200, 400 is matched across the entire band (5-6.5 GHz), it can be inferred that the energy is mostly dissipated in the chip resistor in the antenna stopbands. This illustrates that a well-matched antenna does not necessarily radiate effectively. Again, the simulated result of the reference patch antenna is included in FIG. 8. As expected, the reference patch antenna does not have any sharp filtering response.

Figure 9:
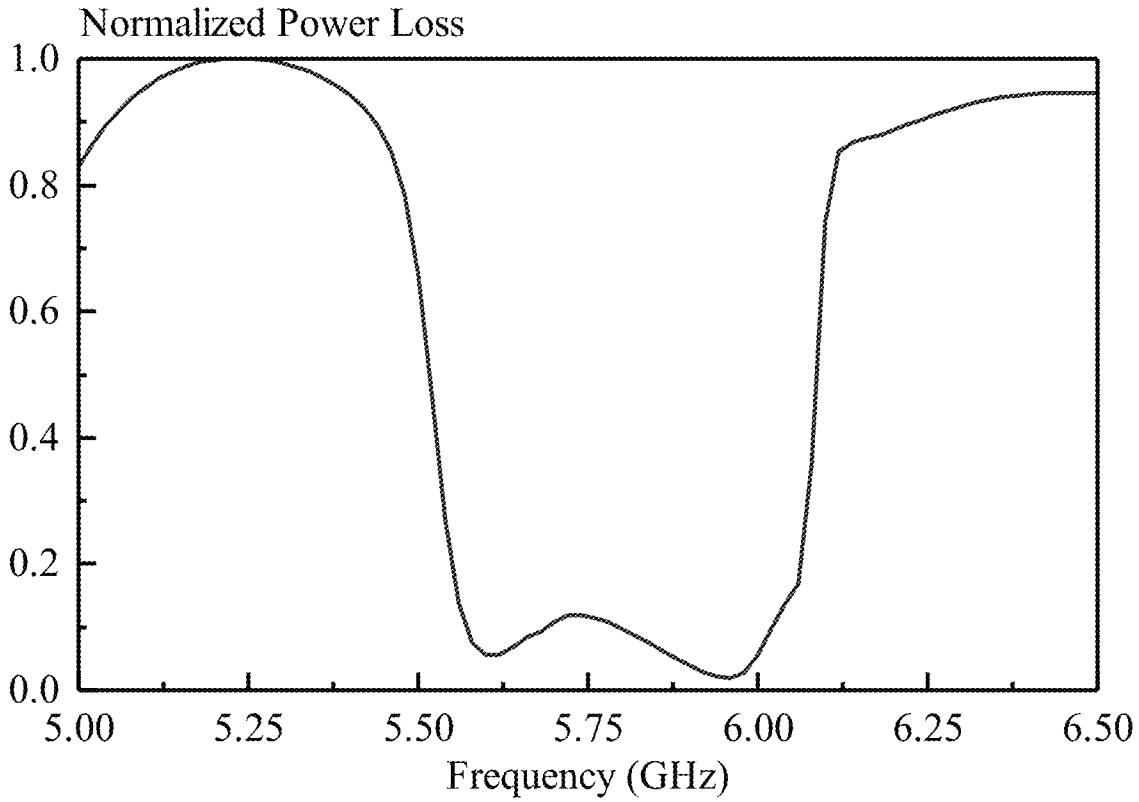
FIG. 9 is a graph showing simulated power loss (normalized with respect to its maximum at 5.24 GHz) in the chip resistor in the filter-antenna of FIG. 2A.

The simulated power loss in the chip resistor is shown in FIG. 9. The results in FIG. 9 have been normalized with respect to the maximum at 5.24 GHz. With reference to FIG. 9, the normalized power loss is lower than 0.12 in the 1-dB gain passband (5.63-5.97 GHz) and higher than 0.85 in the stopbands (5.00-5.44 GHz and 6.12-6.50 GHz) with sharp band-edge selectivity. It should be noted that the frequency response of the normalized power loss in FIG. 9 is almost complementary to that of the simulated efficiency in FIG. 8. This suggests that the band-stop filter and the filtering patch antenna have generally-complementary transfer functions, which are required to reduce or eliminate reflection.

The above embodiments of the invention have generally provided a filter-antenna that can effectively reduce reflection of energy, in particular energy in the stopband. The filter-antenna is compact, low-profile, and small, and is suitable for miniature communication devices and systems. The above embodiments of the invention can be used in the wireless transmitter to reduce the system size and loss. The filter-antenna in the above embodiment has four radiation nulls that can be tuned independently to facilitate the design. A resistor-terminated band-stop filter is embedded at the center of the patch antenna to absorb the energy in the stopbands. The band-stop filter consists of a defected ground structure, a defected microstrip structure, along with the chip resistor. Good impedance matching is achieved in the passband and in the stopband.

The filter-antenna in the above embodiments may reduce, avoid, or prevent the energy in the stopband from reflecting back to the source or other components, by absorbing or dissipating the energy through a filter (esp., resistor). The energy in the passband is transmitted to the antenna, whereas the energy in the stopbands is absorbed by the filter (esp., resistor). As a result, the energy reflection is greatly reduced or even eliminated in both the passband and stopbands, which avoid possible detrimental effects on the source or other components.

It will be appreciated by person skilled in the art that numerous variations and/or modifications may be made to the invention as shown in the specific embodiments without departing from the spirit or scope of the invention as broadly described. The described embodiments of the invention should therefore be considered in all respects as illustrative, not restrictive.

For example, the filter-antenna need not be a patch antenna but can be other forms of microstrip antennas. The substrate of the antenna can be formed by one or more substrate layers, of the same or different dielectric constants (er). The dielectric constant of the substrate layer can vary. The shape, form, and size of the substrate; the shape, form, and size of the ground plane; and the shape, form, and size of the microstrip network or patch network can be different. The patch network can have any number of (at least one) patches with any of shape and form. The patch(es) need not necessarily be arranged symmetrically. The patches could form an array to give an array antenna (integrated with filter). The feed of the antenna can be non-coaxial feed, such as microstrip feed. The feed need not be perpendicular to the face of the substrate, but can be parallel or at any other angles to the face of the substrate. The filter-antenna can be made with different form factors. The filter-antenna can be used for other radio frequencies (e.g., microwave) not specifically mentioned above.

The invention claimed is:

1. A filter-antenna, comprising:

a microstrip antenna integrated with an absorptive filter for absorbing or dissipating energy;

wherein the microstrip antenna includes a substrate, a ground plane arranged on a first face of the substrate, and a microstrip network arranged on a second, opposite face of the substrate; and wherein the absorptive filter includes a filter element at least partly arranged inside the substrate;

a defected microstrip structure arranged in the microstrip network and operably connected with the filter element; and a defected ground structure arranged in the ground plane and operably connected with the filter element.

2. The filter-antenna of claim 1, wherein the microstrip antenna is a patch antenna.

3. The filter-antenna of claim 1, wherein the absorptive filter is a band-stop filter for absorbing or dissipating stopband energy.

4. The filter-antenna of claim 1, wherein the filter element is arranged substantially completely inside the substrate.

5. The filter-antenna of claim 4, wherein the filter element comprises a resistor.

6. The filter-antenna of claim 4, wherein the filter element comprises a chip resistor.

7. The filter-antenna of claim 1, wherein the microstrip antenna is a patch antenna and the microstrip network comprises a patch.

8. The filter-antenna of claim 7, wherein the patch includes a central portion, and the defected microstrip structure comprises one or more slots arranged in the central portion of the patch.

9. The filter-antenna of claim 8, wherein the central portion of the patch includes one or more open stubs each associated with a respective slot.

10. The filter-antenna of claim 9, wherein the patch further includes a first side portion connected with and arranged a first side of the central portion and a second side portion connected with and arranged at a second, opposite side of the central portion, and wherein each of the first and second side portions includes one or more stubs.

11. The filter-antenna of claim 9, wherein the defected ground structure comprises one or more slots arranged in the ground plane.

12. The filter-antenna of claim 11, wherein the defected ground structure comprises a central slot corresponding to the central portion of the patch.

13. The filter-antenna of claim 12, wherein the defected ground structure further comprises a first side slot arranged on a first side of the central slot and a second side slot arranged on a second, opposite side of the central slot.

14. The filter-antenna of claim 7, wherein the patch is symmetric about an axis of symmetry.

15. The filter-antenna of claim 7, wherein the microstrip network further comprises one or more parasitic patches operably connected with the patch.

16. The filter-antenna of claim 15, wherein the one or more parasitic patches are spaced apart from the patch.

17. The filter-antenna of claim 16, wherein the one or more parasitic patches comprises two parasitic patches arranged at opposite sides of the patch.

18. The filter-antenna of claim 17, wherein the two parasitic patches are slotted patches.

19. The filter-antenna of claim 18, wherein the two parasitic patches are equally spaced apart from the patch and symmetrically disposed about the patch.

20. The filter-antenna of claim 7, wherein the patch antenna has a coaxial feed that extends through the substrate and connects with the patch.

21. The filter-antenna of claim 20, wherein the coaxial feed is connected at one end of the patch and the filter element is connected at another end of the patch.

22. A method for making a filter-antenna, comprising:

forming a microstrip antenna integrated with an absorptive filter for absorbing or dissipating energy, comprising:

forming a microstrip antenna; and integrating, in the microstrip antenna, an absorptive filter for absorbing or dissipating energy;

wherein forming the microstrip antenna comprises forming a microstrip network on a first face of a substrate of the microstrip antenna;

forming a defected microstrip structure in the microstrip network; and forming a defected ground structure on a ground plane on a second, opposite face of the substrate of the microstrip antenna; and wherein integrating the absorptive filter comprises forming a hole in the substrate for receiving a filter element of the absorptive filter.

23. The method of claim 22, wherein the microstrip antenna is a patch antenna.

24. The method of claim 22, wherein integrating the absorptive filter further comprises:

arranging the filter element of the absorptive filter in the hole.

25. The method of claim 24, wherein arranging the filter element of the absorptive filter in the hole comprises arranging the filter element of the absorptive filter substantially completely in the hole.

26. The method of claim 24, further comprising:

forming an electric connection between the filter element and the ground plane and an electric connection between the filter element and the microstrip network.

* * * * *